US006880640B2

(12) United States Patent
Barratt et al.

(10) Patent No.: US 6,880,640 B2
(45) Date of Patent: Apr. 19, 2005

(54) STEEL TUBE FLYING LEAD JUMPER CONNECTOR

(75) Inventors: Richard Kenneth Oakley Barratt, Houston, TX (US); Robert Duane Fross, Houston, TX (US)

(73) Assignee: Offshore Systems Inc., Houston, TX (US)

( * ) Notice: Subject to any disclaimer, the term of this patent is extended or adjusted under 35 U.S.C. 154(b) by 33 days.

(21) Appl. No.: 10/207,304

(22) Filed: Jul. 29, 2002

(65) Prior Publication Data

US 2004/0016548 A1 Jan. 29, 2004

(51) Int. Cl.[7] ..... E21B 29/12
(52) U.S. Cl. ..... 166/346; 166/339; 166/344
(58) Field of Search ..... 166/346, 347, 166/348, 338, 339, 340, 344, 368

(56) References Cited

U.S. PATENT DOCUMENTS

| | | | | | |
|---|---|---|---|---|---|
| 3,380,520 | A | * | 4/1968 | Pease | 166/352 |
| 3,448,799 | A | * | 6/1969 | Ahlstone | 166/346 |
| 4,279,544 | A | * | 7/1981 | Brun et al. | 405/202 |
| 4,362,215 | A | * | 12/1982 | Sparks | 166/367 |
| 4,607,701 | A | | 8/1986 | Gundersen | |
| 4,612,994 | A | * | 9/1986 | Castel et al. | 166/344 |
| 4,730,677 | A | * | 3/1988 | Pearce et al. | 166/345 |
| 5,244,045 | A | * | 9/1993 | Mota | 166/341 |
| 5,255,744 | A | | 10/1993 | Silva | |
| 5,265,980 | A | | 11/1993 | Lugo et al. | |
| 5,295,547 | A | * | 3/1994 | Coelho et al. | 166/368 |
| 5,320,175 | A | | 6/1994 | Ritter et al. | |
| 5,341,884 | A | | 8/1994 | Silva | |
| 5,857,808 | A | * | 1/1999 | de Baan | 405/224 |
| 6,102,124 | A | * | 8/2000 | Skeels et al. | 166/347 |
| 6,176,308 | B1 | * | 1/2001 | Pearson | 166/65.1 |
| 6,213,215 | B1 | | 4/2001 | Breivik et al. | |
| 6,223,675 | B1 | | 5/2001 | Watt et al. | |
| 6,227,301 | B1 | | 5/2001 | Edwards et al. | |
| 6,276,874 | B1 | | 8/2001 | Norholmen et al. | |
| 6,283,206 | B1 | | 9/2001 | Fraser et al. | |
| 6,371,693 | B1 | * | 4/2002 | Kopp et al. | 405/158 |
| 6,386,290 | B1 | | 5/2002 | Headworth | |
| 6,397,948 | B1 | * | 6/2002 | Williams et al. | 166/363 |
| 6,422,315 | B1 | * | 7/2002 | Dean | 166/339 |

* cited by examiner

*Primary Examiner*—Thomas B. Will
*Assistant Examiner*—Thomas A Beach
(74) *Attorney, Agent, or Firm*—Bracewell & Patterson LLP

(57) ABSTRACT

A jumper for transferring fluids from an umbilical to a subsea tree assembly has a plurality of steel tubes. The steel tubes are bent so that the jumper is in a serpentine or w-shape while in a natural state. The steel allows resists damage to the jumper from the fluids and chemicals being transferred to the tree assembly. The w-shape of the jumper allows the jumper to be stretched or contracted so that the distance between the connectors on each end of the jumper can vary. The contracted width jumper is attached to a terminal plate located on the tree assembly as it is landed on a subsea wellhead. An ROV disconnects the jumper and connects the jumper to receptors on the tree assembly and the umbilical, while stretching the jumper to the necessary length to reach the receptors. The jumper can be disconnected from the tree assembly when maintenance is necessary without moving the umbilical.

26 Claims, 5 Drawing Sheets

STEEL TUBE FLYING LEAD JUMPER CONNECTOR

BACKGROUND OF THE INVENTION

1. Field of the Invention

The present invention relates generally to subsea well installations, more specifically, to a jumper apparatus for connecting an umbilical to a subsea tree assembly.

2. Background of the Related Art

After a subsea tree assembly is landed on a subsea well assembly, hydraulic fluid control, electrical control, and in some cases chemicals are supplied from a surface platform. An umbilical is lowered from the platform to the tree assembly to supply the hydraulic fluid control, electrical control, and chemicals. Typically, the umbilical is connected to an umbilical terminal head, which in turn is connected to the tree assembly with a flying lead or a jumper. The jumper has multiple tubes that are bundled together so that different chemicals, fluids, and signals can be delivered to the tree assembly separately. The tree assembly normally has a single connection point for the jumper to connect. From the connection point, the different fluids and signals received are routed separately to different parts of the tree assembly.

Prior art jumpers are made of flexible thermoplastic hoses. The thermoplastic hoses are easily maneuverable to extend from the umbilical terminal head to the connector on the tree assembly. The flexibility allows the jumper to be disconnected from the tree assembly for workover operations. The hoses are also made with extra length so that jumper can easily span the distance between the umbilical terminal head and the connector on the tree assembly.

While the thermoplastic hoses allow the hoses to be maneuvered in many directions between the connections on the umbilical and the tree assembly, thermoplastic hoses are not as resistant to chemical attack from the fluids that they transport, as desired. Thermoplastic hoses also degrade when submerged in sea water for long periods of time.

BRIEF SUMMARY OF THE INVENTION

In a subsea well installation a tree assembly is landed onto the subsea well head. The hydraulic fluid control, electrical control, and chemicals for the well assembly are supplied to the tree assembly from the surface through an umbilical that extends downward so that its end or terminal head rests at a location near the tree assembly. A jumper connects the umbilical terminal head to the tree assembly. The umbilical and the tree assembly both have connector receptacles for the ends of the jumper to stab into in order fluidly connect the umbilical to the tree assembly.

The jumper is lowered down with the tree assembly when the tree assembly is landed. A terminal parking plate is located on an exterior surface of the tree assembly adjacent to the tree receptacle. The jumper has an umbilical connector and a tree connector at opposite ends of the jumper which are attached to two terminal parking receptacles on a terminal parking plate while the tree assembly is being landed. The jumper is made up of a set or bundle of metal tubes. The tubes are bent in multiple places which makes the bundle capable of expanding or contracting in effective length from the umbilical connector to the tree connector.

When the jumper is parked on the terminal parking plate, the jumper is in its contracted state. In this state, the umbilical and tree connectors are closer together than the actual distance between the umbilical terminal head and the tree receptacle. The jumper is flexed or expanded for the tree connector and umbilical connectors to connect to the umbilical terminal head and tree receptacle.

DETAILED DESCRIPTION OF THE PREFERRED EMBODIMENT

Figure 1:
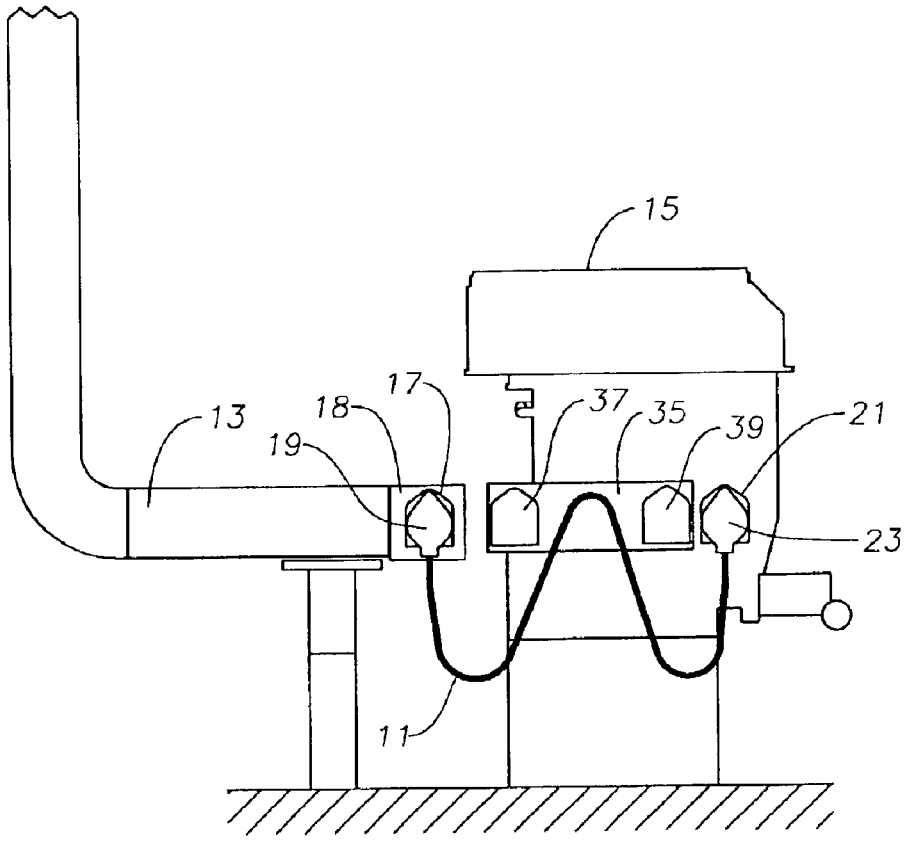
FIG. 1 is an elevational view of a subsea well assembly comprising a jumper, an umbilical, and a subsea tree assembly constructed in accordance with this invention.

Referring to FIG. 1, a flying lead or jumper 11 connects an umbilical 13 to a subsea tree assembly 15 landed on a subsea well. Jumper 11 communicates hydraulic fluid control, electric signals, and/or chemicals from umbilical 13 to tree 15. Umbilical 13 leads to a production platform (not shown) at the surface. Jumper 11 connects to umbilical 13 at an umbilical stab plate or receiver 17 located at an umbilical terminal head 18. In the preferred embodiment, an umbilical connector 19 located at the end of jumper 11 closest to umbilical 13 stabs into receiver 17. Jumper 11 connects to tree assembly 15 at a tree stab plate or receiver 21. In the preferred embodiment, a tree connector 23 located at the end of jumper 11 oppositely situated from umbilical connector 19, stabs into tree receiver 21.

Figure 2:
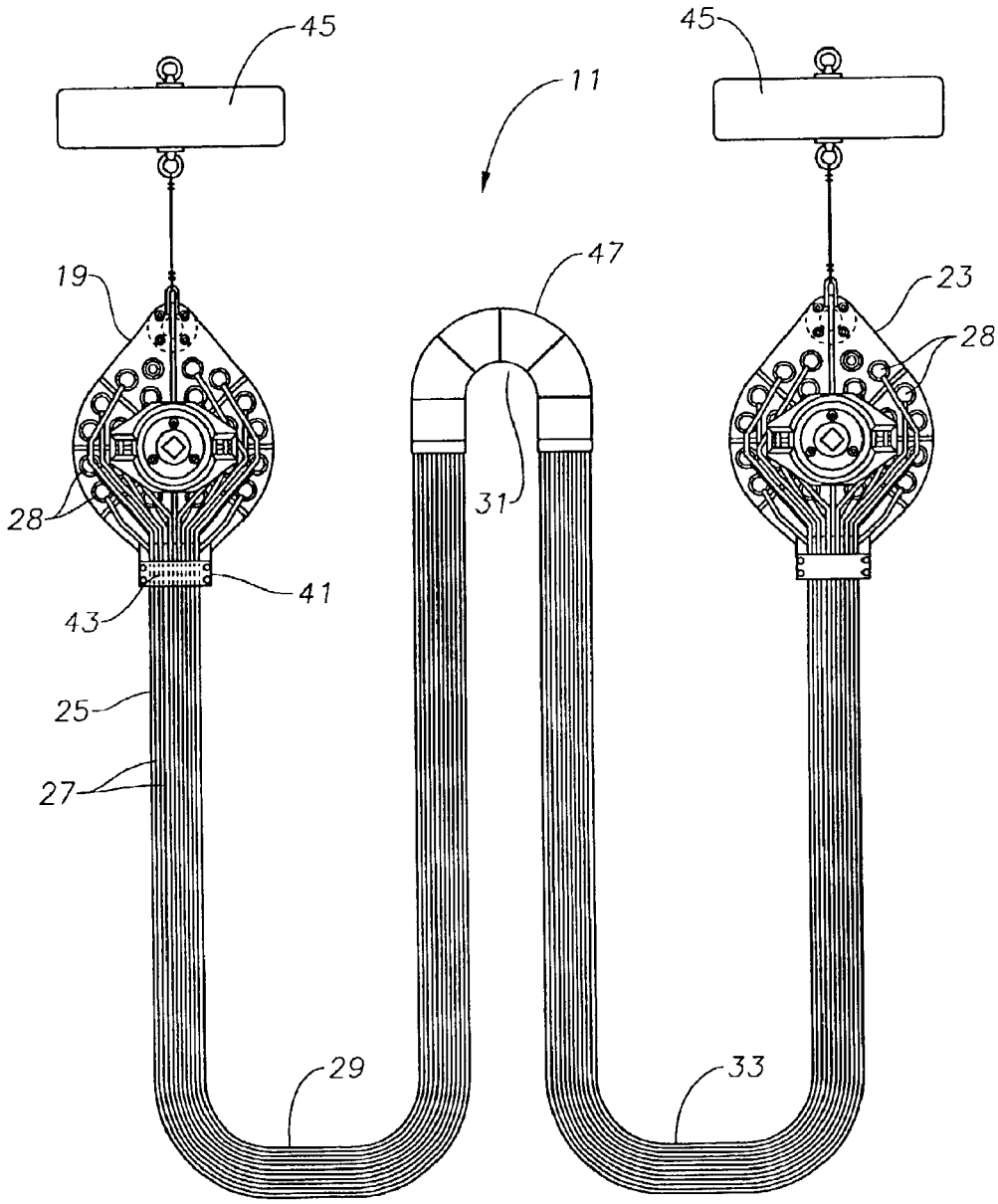
FIG. 2 is an enlarged elevational view of the jumper of FIG. 1.

Referring to FIG. 2, jumper 11 is comprised of a set or bundle 25 of tubes 27. Typically tubes 27 are steel, but can be another metal resistant to corrosion and chemical attack. Both umbilical connector 19 and tree connector 23 have a plurality of tubular connectors 28 for attaching the ends of the tubes 27 to connectors 19 and 23. Receptors (not shown) are located on both umbilical and tree receivers 17 (FIG. 1) and 21 (FIG. 1) for receiving connectors 28. Tubular connectors 28 on tree connector 23 matingly fit with the receptors (not shown) in tree receiver 21 (FIG. 1) when connector 23 stabs into receiver 21. Likewise, tubular connectors 28 on umbilical connector 19 matingly fit with the receptors (not shown) in umbilical receiver 17 (FIG. 1) when connector 19 stabs into receiver 21. Individual connectors 28 for each tube 27 allow different fluids to be transferred from umbilical 13 (FIG. 1) to tree 15 (FIG. 1) within a single bundle 25.

A natural state distance is defined herein by the distance between umbilical connector 19 and tree connector 23 when bundle 25 is in its natural condition, without being flexed to either expand or contract. The total length of bundle 25 of jumper 11 is greater than the natural distance between the umbilical and tree connectors 19 and 23. Bundle 25 of jumper 11 is flexible and resilient so that connectors 19 and 23 can be pushed closer together or pulled farther apart from each other than in their natural position. During normal use expanding and contracting the distance between connectors 19 and 23 will not exceed the yield strength of metal tubes 27. The flexibility and resilience of jumper 11 is due to the serpentine configuration of bundle 25. Tubes 27 extend downward in bundle 25 from the lower portion of umbilical connector 19. After a desired distance, tubes 27 form an umbilical bend 29 in a substantially u-like manner towards tree connector 23 and extend upward until tubes are substantially level with connector 19. Tubes 27 change direction at another bend or bight 31 which is substantially level with umbilical connector 19. Bight 31 is substantially a u-shaped bend which redirects tubes 27 of bundle 25 downward. Tubes 27 form a tree bend 33 in a u-like manner that directs tubes 27 towards tree connector 23 at substantially the same level as bend 29. Tubes 27 in bundle 25 extend from bend 33 to the lower portion of tree connector 23. This arrangement results in four separate legs and three bends. The combination of bend 29, bight 31, and bend 33 forms a substantially serpentine or w-shaped bundle 25 of jumper 11. Of course more than four legs is feasible.

Typically, the w-shape of bundle 25 is formed with the natural, unflexed distance between connectors 19 and 23 being smaller than the distance between umbilical plate 17 and tree plate 21 (FIG. 1). Jumper 11 flexes from its natural state to enable connectors 19 and 23 to connect to umbilical and tree receivers 17 (FIG. 1) and 21 (FIG. 1).

A clamp plate 41 is located at the base of each of connectors 19 and 23. Passages 43 are located in clamp plate 41 that separately enclose each individual tube 27 of bundle 25 extending toward connector 19 or 23. Typically, a liner (not shown) will be located on the inner surface of passages 43 or the portion of each tube 27 enclosed by passage 43. In the preferred embodiment, the liner (not shown) is either a nylon or a plastic material, which is used to protect the tubes as connectors 19 and 23 are moved to contract or expand the natural unflexed length of bundle 25. The portion of tubes 27 below clamp plate 41 is in the bundle arrangement comprising bundle 25. The portion of tubes 27 above clamp plate 41 extends separately to each of their respective tubular connectors 28. Clamp plate 41 prevents the portions of tubes 27 extending above clamp 41 from bending as bundle 25 is flexed and compressed, which may relieve stress on tubular connectors 28.

In the preferred embodiment, a cover sleeve 47 is located around the portion of bundle 25 in bight 31. Cover sleeve is preferably a plastic or nylon material that protects tubes 27 and tree assembly 25 during any contact while bundle is flexed.

Figure 3:
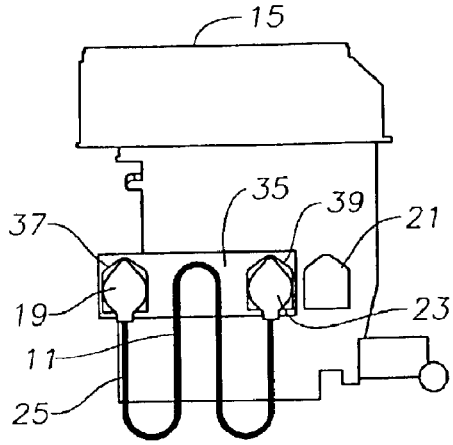
FIG. 3 is an elevational view of the jumper of FIG. 1, shown mounted to a terminal parking plate located on the subsea tree assembly of FIG. 1.
Figure 8:
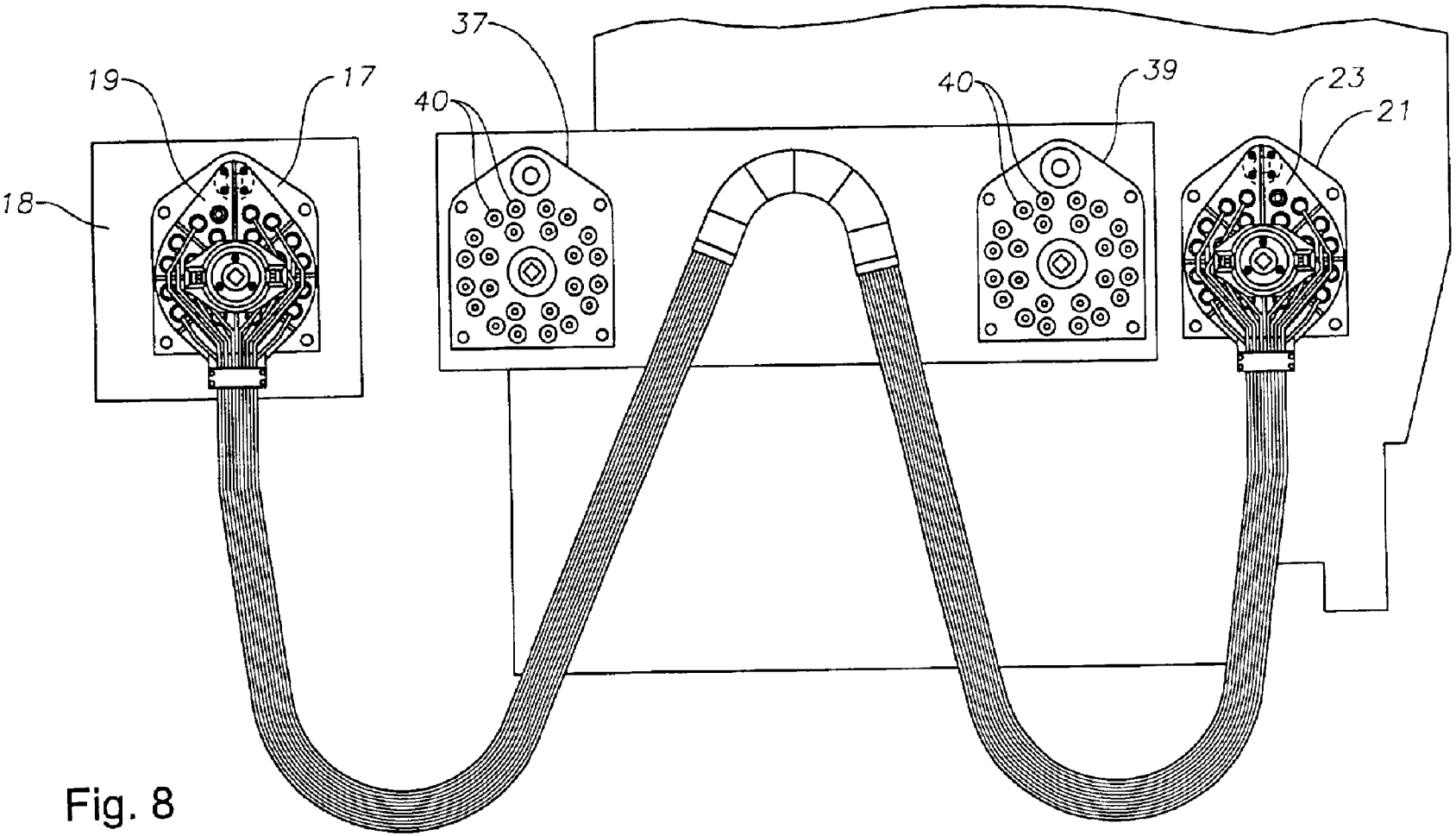
FIG. 8 is an enlarged elevational view similar to FIG. 2, but showing the tree end of the jumper in a parked position and the umbilical end of the jumper connected to the umbilical stab plate.

Referring to FIG. 3, a jumper parking terminal plate 35 is mounted on tree assembly 15 adjacent to tree plate 21. Parking plate 35 is a removable plate that is preferably landed with tree assembly 15. Parking plate 35 has two parking terminals 37 and 39 adjacent to each other which face away from tree assembly 15. Parking terminals 37 and 39 are blank receptacles 40 (as shown in FIG. 8) that are not connected to any components of the tree. Connectors 19 and 23 stab into parking terminals 37 and 39 to retain jumper 11 with tree assembly 15 as it is lowered with tree assembly 15 from the surface while tree assembly 15 is landed. Typically, the w-shape of bundle 25 is formed with a natural unflexed distance between connectors 19 and 23 that is greater than the distance between parking terminals 37 and 39. Jumper 11 is contracted so that connectors 19 and 23 can stab into parking terminals 37 and 39.

Typically, a restraining mechanism (not shown) is used to maintain the contracted state of jumper 11 even after one of connectors 19 or 23 is removed from their terminal 37 or 39. The restraining mechanism (not shown) can slowly release jumper 11 from its contracted state so that jumper 11 and other equipment does not get damaged when either connector 19 or 23 is removed from terminal 37 or 39.

Figure 4:
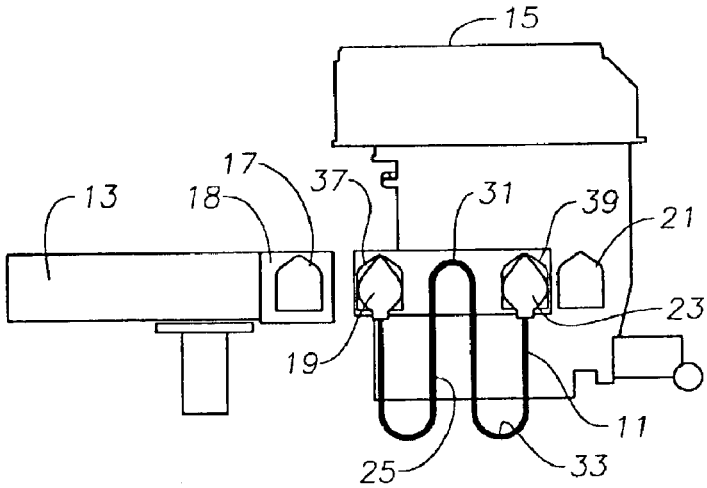
FIG. 4 is an elevational view similar to FIG. 3, but showing the terminal head of the umbilical of FIG. 1 lowered to an area adjacent to the tree assembly.

In operation, jumper 11 is contracted and connectors 19 and 23 are stabbed into terminals 37 and 39 on parking plate 35 which is already secured to tree assembly 15 as shown in FIG. 3. Tree assembly 15 is then lowered from a vessel and landed on a subsea well (not shown) on the ocean floor. As shown in FIG. 4, umbilical 13 is lowered from a vessel on the surface after landing tree assembly 15 so that umbilical terminal head 18 having umbilical plate 17 is closer to umbilical connector 19 than to tree connector 23. Umbilical terminal head 18 will be fairly closely spaced to tree assembly 15, but the distance is variable. Umbilical terminal head 18 lands on the sea floor adjacent to tree assembly 15.

An ROV is used to remove tree connector 23 from parking terminal plate 39. The restraining mechanism (not shown) maintains pressure on bundle 25, preventing bundle 25 from expanding too quickly and damaging jumper 11 or tree assembly 15. The ROV gradually releases the restraining mechanism (not shown) which allows jumper 11 to expand. The ROV then pulls tree connector 23 until it is aligned with tree receiver plate 21. Pulling tree connector 23 causes bundle 25 to expand. A pair of buoyancy modules 45 (as shown in FIG. 2), which attach to the upper portions of connectors 19 and 23, help to support the weight of jumper 11 as the ROV moves different portions of jumper 11. Bend 33 and bight 31 both expand as connector 23 is pulled away from umbilical connector 19, which remains stabbed into terminal parking plate 37.

Figure 5:
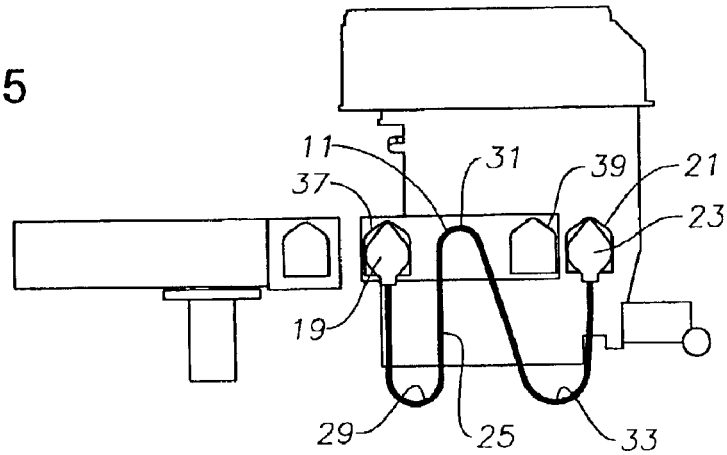
FIG. 5 is an elevational view similar to FIG. 4, but showing the jumper of FIG. 1 being connected to the tree assembly of FIG. 1.

As shown in FIG. 5, the distance between the straight portions of bundle 25 extending away from bight 31 towards bends 29 and 33 increases as bight 31 expands. The distance between portions of bundle 25 extending from bend 33 towards bight 31 and tree connector 23 also increases as bend 33 expands. The increase in distances between the straight portions accounts for most of the increase in the actual distance between connectors 19 and 23. The straight portion of bundle 25 between connector 23 and tree bend 33 may bend slightly away from umbilical connector 19. The straight portion of bundle 25 between bight 31 and bend 33 may also bend slightly. Then the ROV stabs tree connector 23 into tree plate 21, as shown in FIG. 5, which connects tubular connectors 28 (FIG. 2) on tree connector 23 to the receivers (not shown) located on tree plate 21.

Figure 6:
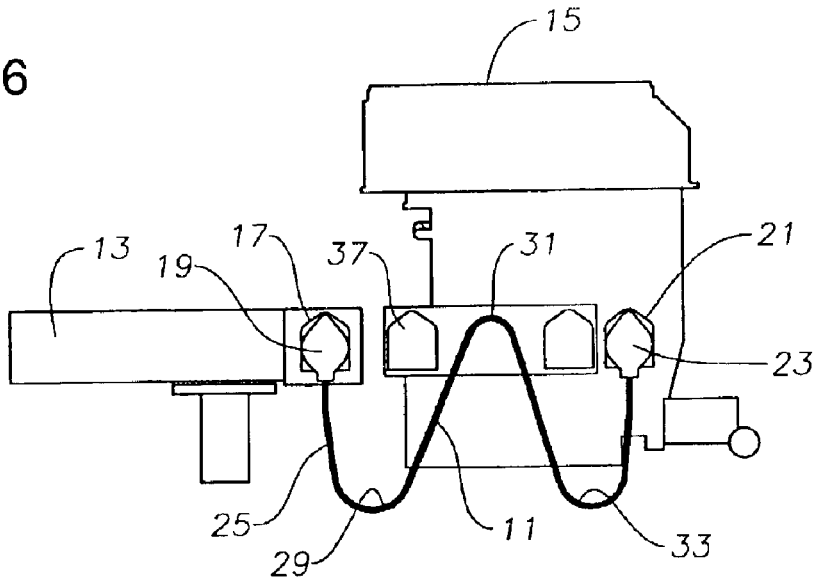
FIG. 6 is an elevational view similar to FIG. 5, but showing the jumper of FIG. 1 being connected to the umbilical of FIG. 1.

The ROV then removes umbilical connector 19 from parking terminal 37. The ROV pulls umbilical connector 19 away from tree connector 23 towards umbilical plate 17. As shown in FIG. 6, the distance between straight portions of bundle 25 extending from bight 31 towards bends 29 and 33 continues to increase when connector 19 is pulled towards umbilical plate 17. The distance between portions of bundle 25 extending from bend 29 towards umbilical connector 19 and bight 31 also increases when connector 19 is pulled towards umbilical plate 17. The increase in the distance between the straight portions from bend 29 and bight 31 accounts for most of the increase in the actual distance between connectors 19 and 23 for connector 23 to connect to umbilical plate 17. As before, the straight portions of bundle 25 extending from bend 29 and bight 31 may also bend slightly as umbilical connector 19 is pulled by the ROV towards plate 17. The ROV then stabs umbilical connector 19 into plate 17 which connects tubular connectors 28 on connector 19 to the receivers (not shown) located on plate 17.

With jumper 11 in the configuration shown in FIG. 6, the operator can pump hydraulic fluids, chemicals, and communicate signals from umbilical 13 through tubes 27 (FIG. 2) in jumper 11 to tree assembly 15. The hydraulic fluids, chemicals, and electrical signals communicate from each tube 27 to the receivers (not shown) on tree assembly 15, which then communicates the fluids, chemicals, and signals to different portions of tree assembly 15 and the well. In the portion of FIG. 3, jumper 11 is elastically contracted from its natural position, but to a point to exceed the yield strength of jumper 11.

Figure 7:
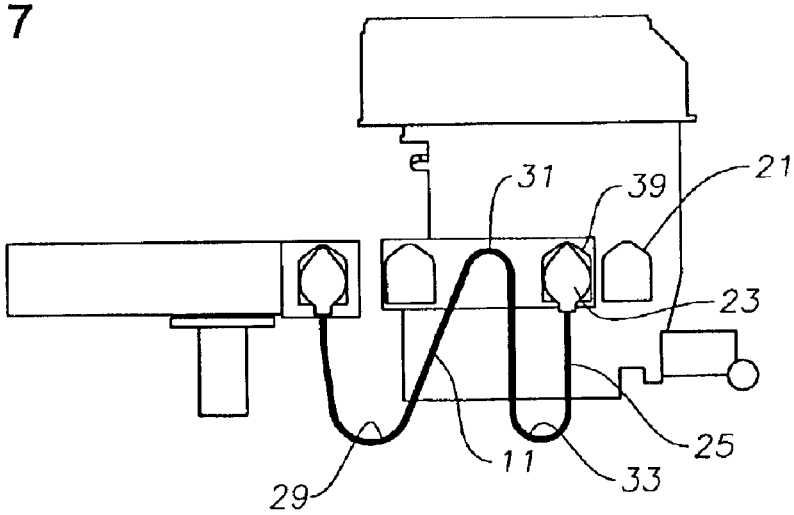
FIG. 7 is an elevational view similar to FIG. 6, but showing the jumper of FIG. 1 being removed from the tree assembly of FIG. 1 to perform maintenance to the tree assembly.

When the operator needs to workover the well, the ROV is used to place jumper 11 in the configuration shown in FIG. 7. The ROV disengages tree connector 23 from tree plate 21 by pulling connector 23 perpendicularly away from plate 21. The ROV then moves connector 23 towards terminal parking plate 39. In doing so, the width of bundle 25 of jumper 11 reduces. The distance between the portions of bundle 25 extending from bight 31 towards bends 29 and 33 decreases as the ROV moves connector 23 towards terminal 39. The distance between the portions of bundle 25 extending from bend 33 also decreases with the movement of connector 23 by the ROV.

The ROV contracts the width bundle 25 until connector 23 aligns with parking terminal 39. Then the ROV stabs connector 23 into terminal 39 by pushing connector 23 towards plate 39 from a direction that is substantially perpendicular to parking terminal 35. In this configuration, a line (not shown) from a workover vessel can stab into tree plate 21 to perform the necessary workover. Upon completion of the workover, the ROV removes connector 23 from terminal 39 in terminal plate 35, allows bundle 25 to expand in width to its natural position, and then flexes bundle 25 until connector 23 aligns with tree plate 21, and then stabs connector 23 back into plate 21 so that jumper 11 is once again in the configuration shown in FIG. 5.

If the operator needs to use jumper 11 on another well assembly, the ROV disengages umbilical connector 19 from plate 17. Then the ROV moves connector 19 and aligns it with terminal 37 by contracting bundle 25. The ROV then stabs connector 19 into terminal 37. The ROV would then remove connector 23 from tree plate 21, contracting bundle 25 while moving and aligning connector with terminal 39, and stabing connector 23 into terminal 39. After these operations, jumper 11 is in the configuration shown in FIG. 3. The operator can then remove terminal plate 35 along with jumper 11 from tree assembly 15 to use jumper 11 with another tree assembly.

The flexibility of bundle 25 allows jumper 11 to be connected and disconnected like the conventional thermoplastic hoses while the steel material of tubes 27 in bundle 25 provide resistance to chemical attack and sea water. A jumper made of steel as described above saves money because jumper 11 does not need to be replaced, avoiding delays in oil or gas production. Jumper 11 allows umbilical 13 to be lowered to the general proximity of the tree assembly 15 instead of being lowered to a precise location, which is more expensive and time consuming. Further, jumper 11 may be readily disconnected in order for a workover on the tree assembly 15 to occur.

Normally, the metal needed to travel from umbilical connector 19 to tree connector 23 would not compress enough to maneuver connectors 19 and 23 between umbilical 13 (FIG. 1) and tree 15 (FIG. 1) that are closer together than the length of the jumper. Similarly, the metal would not stretch if the distance between connectors 19 and 23 was greater than the length of the jumper. The w-shape of bundle 25 increases the length of tubes 27 in bundle 25. The increase in length in addition to the w-shape of bundle 25 allows jumper 11 to increase and decrease the actual distance between connectors 19 and 23, when bundle 25 is flexed or compressed.

While the invention has been shown in only a few of its forms, it should be apparent to those skilled in the art that it is not so limited, but is susceptible to various changes without departing from the scope of the invention.

What is claimed is:

1. A subsea assembly for transferring fluids between subsea structures, comprising:

a subsea tree assembly located on the seafloor having a tree stab plate mounted to the subsea tree;

a tree end parking receptacle mounted to the tree assembly adjacent the tree stab plate;

an umbilical end parking receptacle mounted to the tree assembly adjacent the tree end parking receptacle;

an umbilical extending from a vessel on the ocean surface towards the seafloor and having an umbilical terminal head spaced from the subsea tree, the umbilical terminal head having an umbilical stab plate;

a bundle of a plurality of metal tubular members each having an umbilical end connector and a tree end connector; wherein the bundle has a parked position wherein the tree end connector of the bundle stabs into the tree end parking receptacle and the umbilical end connector stabs into the umbilical end parking receptacle; and wherein the bundle has a length which allows the bundle to be flexed into an operational position having the tree end connector stabbed into the tree stab plate and the umbilical end connector stabbed into the umbilical stab plate.

2. The subsea assembly of claim 1, wherein the bundle has a serpentine configuration in its natural state.

3. The subsea assembly of claim 1, wherein the tree end and umbilical end parking receptacles are located on a terminal parking plate that is removeably attached to the tree assembly adjacent to the tree end stab plate.

4. The subsea assembly of claim 1, further comprising a tree end clamp plate which fixedly attaches to the lower portion of the tree end connector and which individually clamps the individual tubes of the portion of the bundle extending towards the tree end connector.

5. The subsea assembly of claim 4, wherein the tree end clamp plate further comprises a plurality of passages extending through the clamp plate from a lower surface to an upper surface of the clamp plate, each of the passages receiving one of the tubes.

6. The subsea assembly of claim 5, further comprising a plurality of tubular connectors that connect each of the tubes of the bundle to the tree end connector.

7. The subsea assembly of claim 1, wherein the bundle has a serpentine configuration while in a natural unstressed state, and wherein moving from the parked position to the operational position occurs without exceeding the yield strengths of the tubular members of the bundle.

8. The subsea assembly of claim 1, wherein the bundle has a "w" shape while in a natural, unstressed state, and has a "w" shape that is stressed while in the parked and operational positions, and resiliently moves between the parked and operational positions.

9. The subsea assembly of claim 1, wherein a first downward extending portion of the bundle extends downward from the tree end connector and then bends in a substantially u-like manner defining a first bend, and a first upward extending portion of the bundle extends upward alongside the first downward extending portion of the bundle.

10. The subsea assembly of claim 9, wherein a second downward extending portion of the bundle extends downward from the umbilical end connector and then bends in a substantially u-like manner defining a second bend, and a second upward extending portion of the bundle extends upward alongside the second downward extending portion of the bundle, the first and second upward extending portions joining each other in a third bend.

11. The subsea assembly of claim 1, wherein the bundle has a natural unstressed state between the operation position and the parked position.

12. A flying lead for transferring fluids from a subsea structure to another, comprising:

a plurality of metal tubes assembled in a bundle having two spaced apart end connectors adapted to extend from one subsea structure to the other subsea structure;

the bundle having a serpentine configuration and being resiliently flexible between an operational position and a parked position, a distance between the ends of the bundle being greater while in the operational position than in the parked position; and wherein a natural, unstressed position of the bundle is between the operational and parked positions, a distance between the ends of the bundle being greater while in the natural, unstressed position than the parked position, and being smaller while in the natural, unstressed position than in the operational position.

13. A method for connecting an umbilical terminal head to a subsea tree, comprising the following steps:

(a) forming a bundle of metal tubular members into a serpentine configuration, the bundle having a tree end connector and an umbilical end connector;

(b) mounting the tree end connector m a first parking receiver on a subsea tree and the umbilical end connector in a second parking receiver on the subsea tree;

(c) lowering the tree and the bundle into the sea and landing the tree on a subsea well; then (d) lowering an umbilical terminal head to a location adjacent to the tree; then (e) removing the tree end connector from the first parking receiver and stabbing the tree end connector into a tree receiver; and (f) removing the umbilical end connector from the second parking receiver and stabbing the umbilical end connector into an umbilical receiver.

14. The method of claim 13, wherein step (e) further comprises pulling the tree end connector away from the umbilical end connector by an amount that does not exceed a yield strength of the tubular members before stabbing the tree end connector into the tree receiver.

15. The method of claim 13, wherein step (f) further comprises pulling the umbilical end connector away from the tree end connector by an amount that does not exceed a yield strength of the tubular members before stabbing the umbilical end connector into the umbilical receiver.

16. The method of claim 13, wherein before step (b), the method further comprises the step of flexing the bundle beyond a natural width from the tree connector end to the umbilical connector end.

17. A subsea assembly, comprising:

first and second subsea structures located on the seafloor;

first and second stab plates mounted to the first and second subsea structures, respectively, for communicating with the first and second subsea structures;

first and second parking receptacles mounted adjacent the first stab plate;

a metal tubular jumper having first and second end connectors; wherein the jumper has a parked position wherein the first and second end connectors stab into the first and second parking receptacles; and wherein the jumper has a length that allows the jumper to be flexed from the parked position to an operational position with the first and second end connectors stabbed into the first and second stab plates, respectively.

18. The subsea assembly according to claim 17, wherein the jumper has sufficient stiffness and resiliency to bias the jumper toward a natural condition, and wherein moving the jumper from the parked position to the operational position causes stress in the jumper to a level less than the yield strength.

19. The subsea assembly according to claim 17, wherein the jumper has a stiffness and resiliency that biases the jumper to a natural position that occurs when at least one of the end connectors is disconnected from engagement with either one of the stab plates or one of the parking receptacles.

20. The subsea assembly according to claim 17, wherein the second subsea structure comprises an umbilical extending from the surface and having a terminal head located adjacent the first subsea structure, the second stab plate being mounted to the terminal head.

21. The subsea assembly according to claim 17, wherein the first and second parking receivers are mounted to the first subsea structure.

22. A method for connecting first and second subsea structures, comprising:

(a) mounting a first stab plate to a first subsea structure and a second stab plate to a second subsea structure;

(b) providing a tubular metal jumper with first and second end connectors;

(c) stabbing the first and second end connectors into first and second parking receivers, then lowering the jumper and the first and second parking receivers into the sea; then (d) removing the first end connector from the first parking receiver and stabbing the first end connector into the first stab plate; and (e) removing the second end connector from the second parking receiver and stabbing the second end connector into the second stab plate.

23. The method according to claim 22, wherein step (c) comprises mounting the first and second parking receivers to the first subsea structure.

24. The method according to claim 22, wherein step (c) comprises mounting the first and second parking receivers to the first subsea structure, then lowering the first subsea structure into the sea.

25. The method of claim 22, wherein step (b) comprises providing the jumper with a natural configuration that is nonlinear, and providing the jumper with sufficient stiffness and resiliency to bias the jumper toward the natural configuration.

26. The method of claim 25, wherein steps (d) and (e) comprise resiliently flexing the jumper from the natural configuration by an amount that does not exceed a yield strength of the jumper.

* * * * *